United States Patent [19]

Fitzsimmons

[11] Patent Number: 4,542,055

[45] Date of Patent: Sep. 17, 1985

[54] THREE-DIMENSIONAL FABRIC PAINTING SURFACES

[75] Inventor: Christine M. Fitzsimmons, Rochester, Mich.

[73] Assignee: Conceptual Arts, Ltd., Rochester, Mich.

[21] Appl. No.: 543,165

[22] Filed: Oct. 19, 1983

[51] Int. Cl.[4] ..... B32B 3/06; B32B 3/30

[52] U.S. Cl. ..... 428/102; 428/120; 428/167; 428/172; 428/181; 428/542.2

[58] Field of Search ..... 428/102, 167, 174, 181, 428/187, 224, 172, 284, 542.2, 542.6, 120, 121, 123, 130, 156

[56] References Cited

U.S. PATENT DOCUMENTS

| | | | |
|---|---|---|---|
| 793,870 | 7/1905 | Beale | 428/102 |
| 1,655,164 | 1/1928 | Schemmel | 428/123 |
| 1,895,567 | 1/1933 | Blum | 428/102 |
| 2,977,664 | 4/1961 | Grajeck | 428/229 |

*Primary Examiner*—Paul J. Thibodeau

*Attorney, Agent, or Firm*—Harness, Dickey & Pierce

[57] ABSTRACT

Three-dimensional preformed fabric devices for painting, dyeing, silk screening, or other surface design finishing are disclosed. One or more raised ridges or lines is formed on the surface in a predetermined geometric design. The fabric is folded and held in place by stitching. Stiffening members can be inserted in the ridges to define certain shapes or stiffen the ridges.

5 Claims, 3 Drawing Figures

THREE-DIMENSIONAL FABRIC PAINTING SURFACES

BACKGROUND-SUMMARY OF THE INVENTION

The present invention relates to three-dimensional preformed fabric devices for painting, dyeing, silk screening, or other surface design finishing. In particular, one or more rasied ridges or lines is formed on the surface in a predetermined geometric design creating a unique sculpture. The surface preferably is further treated or painted in order to form a certain color, pattern or design on it. The three-dimensional or sculptured surface creates a unique and aesthetic pattern of shadows and effects. That pattern and effect is further enhanced by the further surface treatment or finishing with dyes, paints and the like.

In accordance with the present invention, a series of raised ridges is formed on the canvas or other fabric in a certain design and the material is then stretched or otherwise applied to a frame or other backing material. The ridges are formed by folds in the materials securely held together by stitching or equivalent means. The surface of the materials is further treated with paints or the like. If desired, stiffening materials can be used to stiffen and define a certain shape to the raised ridges.

It is a purpose of the present invention to provide a three-dimensional fabric surface for subsequent design finishing. It is a further purpose of the present invention to provide a sculptured surface for painting, the sculpture being formed of one or more raised ridges. It is another purpose of the invention to provide a new aesthetically-pleasing medium for artists and final sculptures for the public. Further aspects and purposes of the invention will become apparent from the following more detailed description of the invention.

DESCRIPTION OF THE PREFERRED EMBODIMENTS

Figure 1:
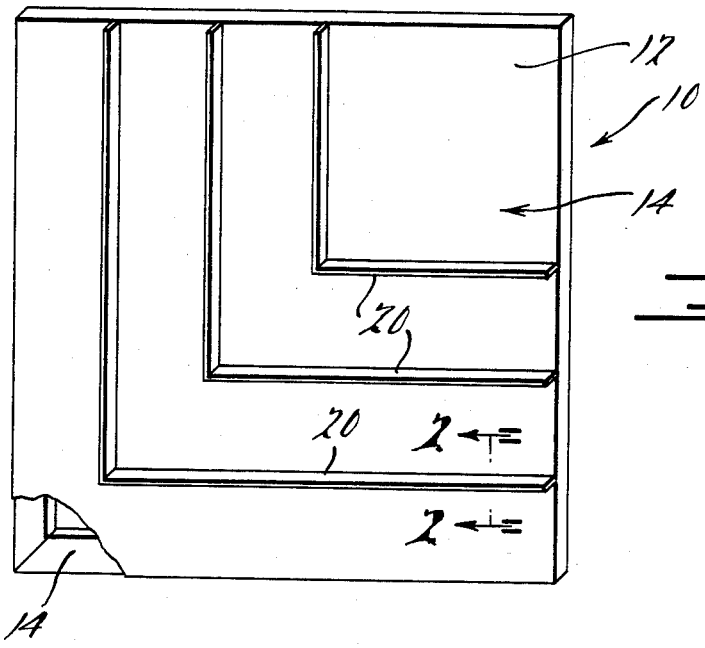
FIG. 1 is an overall view of a painting on canvas utilizing a representative use of the present invention.

A canvas or fabric sculpture in accordance with the present invention is shown in FIG. 1 and indicated generally by the reference numeral 10. The sculpture 10 comprises a piece of canvas 12 or other fabric material (preferably of a type conventionally used by artists) stretched over a wood frame 14. The material 12 is covered on its front surface by a painting or design 14 applied by an artist in a predetermined pattern (not shown).

A series of raised ridges 20 are formed on the surface of the material, forming a three-dimensional or sculptured design. In the design shown in FIG. 1, the ridges 20 are formed in a series of similar L-shaped geometric patterns on the front surface of the fabric.

Figure 2:
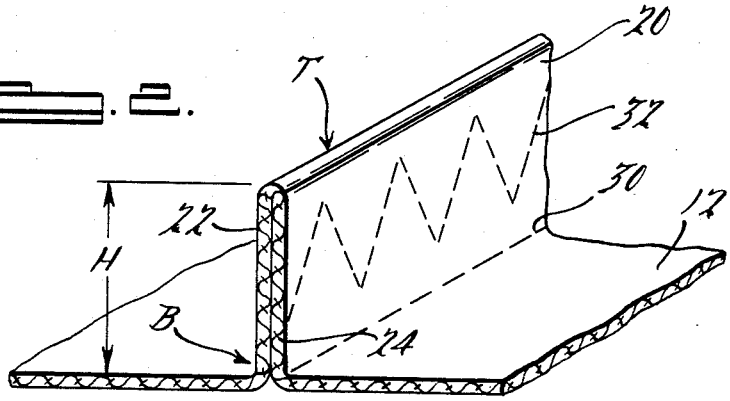
FIG. 2 is a partial cross-sectional view of a portion of the canvas sculpture of FIG. 1 taken along lines 2—2 and in the direction of the arrows thereon.

The details of a ridge is shown in FIG. 2. The ridge 20 is created by a fold made in the material, forming two layers of material 22 and 24 positioned adjacent to each other. The two layers 22 and 24 are securely held together by stitching, such as by a sewing machine or the like. Of course, it is possible to hold the two layers together to form a ridge by any other alternate means, so long as it securely and permanently holds the two layers together. One advantage of stitching is that it is relatively quick, convenient and inexpensive. Also, stitching on fabric material can be made relatively unobvious or nonvisible by appropriate coloring, sizing and shaping of the thread and stitches.

In order to hold the two layers 22 and 24 firmly and uniformly together, a first row of stitching 30 is stitched in place along the base "B" of each ridge. A second row of stitching 32 is stitched along the side surface of each ridge in order to further hold the two layers together. In the embodiment shown in FIG. 2, the second row of stitching 32 is "zig-zag" in shape, but it is understood that any shape of stitching which will accomplish the stated purpose would be sufficient. Also, the height and thickness of the ridges 20 may dictate the type and size of stitching, as well as the number of rows that are needed to hold the layers together. For example, with ridges of over 2 inches in height, three rows of stitching may be necessary.

It is understood in accordance with the present invention that there are a wide variety of sizes, shapes, styles, types of material, etc. for the various parts of the sculpture which may be utilized For example, the frame (and thus the resultant final sculpture) can be of any size and shape, such as square, rectangular, triangular, circular, large, small, etc. The frame also can be of wood or any other conventional material commonly used as a backing member for paintings and the like.

The material covering the frame and the type of paint or other materials used to finish the surface further can be varied within a wide variety of materials. Canvas is typically used for oil painting, but the covering material could also be any textile made from natural and/or man-made fibers. The materials used to apply to and "finish" the surface of the sculptured devices could be watercolors, acrylic paints, latex based paints, silk screening, etc. and it is possible for the canvas or other surface 12 to be partially or completely devoid of paint or any other covering material. If desired, the canvas or fabric could be made with a dyed design.

It is also understood that the size, shape, pattern and number of raised ridges on the canvas is subject to a wide variety of geometric designs. For example, the raised ridge pattern can be L-shaped lines (as shown in FIG. 1), polygons, circles, arcs, or the like. The height of the raised ridges (dimension "H" in FIG. 2) further is subject to a wide range of dimensions. Different effects and shadows can be created simply by varying the heights of the ridges on the same sculpture.

The number of stitches per row on each raised ridge, the number of rows of stitching on each ridge and the shape or pattern of the stitching also is subject to variation. It is preferable, however (as indicated earlier), to have at least one row of stitching 30 or equivalent fastening means along the base "B" of each ridge 20 in order to fully define the height and shape of the ridge. Of course, if it is desired to have a more random size and shape of ridge, then a curved or intermittent stitching along the base could be employed.

The zig-zag stitching 32 shown in FIG. 2 helps hold together the two layers of material 22 and 24 forming each raised ridge. Elimination of that stitching, or providing it in another pattern or another location on the ridge, could result in a nonuniform or "softer" or "flatter" top "T" on the ridge.

Figure 3:
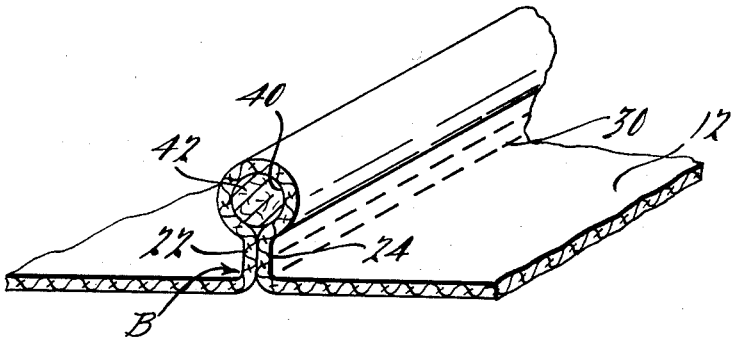
FIG. 3 illustrates an alternate embodiment of the invention.

It is possible to eliminate the zig-zag stitching 32 and allow the top "T" of the ridge to form an elongated tubular channel along its length. A tubular channel 40 of this type is illustrated in FIG. 3. In order to keep the channel uniform and "stiff", it is preferred to insert a stiffening member 42, such as a dowel rod or the like, in each channel. The stiffening member can have any desired cross-sectional shape as suits the artist. It is apparent that different effects and shadows on the sculpture can be created with stiffening members 42 made of oval, triangular or square cross-sections. Different effects can also be created by utilizing differently shaped stiffening members in different areas of the sculpture, or utilizing stiffening members only in certain areas and leaving them out in other areas.

The preferred method of forming the sculptured structure will now be described. When oil painting and canvas is utilized, the frame is first selected of an appropriate size. As is typical with most oil paintings, the frame is usually made of wood. Then, the desired pattern of raised ridges 20 is selected and formed on the canvas. The material is folded along each of the ridges and the first row of stitching 30 is completed. If thin, flat, uniform ridges, such as shown in FIG. 2 are to be utilized, then a second row of stitching 32 is inserted in place. If it is desired to provide ridges with open channels, or with stiffening members, as shown in FIG. 3, then further stitching may be unnecessary. If stiffening members are utilized, they should be inserted in the channels at this time.

The canvas 12 with the raised ridges 20 is then mounted and stretched over the frame 14. The mounting and stretching is carried out in the same conventional manner that is used to mount and stretch flat canvas on frames, although it is more difficult and time-consuming as more care must be utilized to keep the ridges straight.

After the canvas 12 is mounted on its frame or backing member, the surface 14 is then painted with oil paints or the like in any appropriate design or pattern. Once all of the colors and coats of paint are dry, a frame can be mounted on the perimeter of the sculptured canvas and the final sculpture can be hung or placed in a position for viewing.

With other types of fabrics, the method of forming the ridges is the same. The only differences relate to the stage when the desired pattern (if any) is put on the fabric. For example, if a dyed or silk screened pattern is to be utilized, it might be preferable to form the pattern on the fabric before the ridges are formed and the fabric is mounted on the frame.

While it is apparent that the preferred embodiments illustrated herein are well calculated to fulfill the objects above stated, it will be appreciated that the present invention is susceptible to modification, variation and change without departing from the scope of the invention, as defined by the following claims.

I claim:

1. A sculptured fabric comprising a backing member, a layer of fabric material generally describing a plane and secured to said backing member, and at least two raised edge means formed on said fabric material by folding said fabric material so that two layers of said material are positioned adjacent to each other, said two layers being securedly held together to define a free standing ridge generally perpendicular to said plane, and at least two of said raised ridge means having different heights and formed in a prospecified geometric pattern on said material.

2. The sculptured fabric as set forth in claim 1 wherein said raised ridge means includes a connected edge intersecting with said plane and a free edge disposed above said plane.

3. The sculptured fabric as set forth in claim 1 wherein said two layers are securely held together by stitching.

4. The sculptured fabric as set forth in claim 2 wherein said two layers are securely held together by stitching along said connected edge.

5. The sculptured fabric as set forth in claim 1 further comprising stiffening means positioned between said two layers.

* * * * *